US008552817B2

(12) United States Patent
Chen et al.

(10) Patent No.: US 8,552,817 B2
(45) Date of Patent: Oct. 8, 2013

(54) PHASE SHIFTER WITH REVERSELY CONFIGURED ELECTRIC REGULATION UNITS

(75) Inventors: Peng Chen, Hsinchu (TW); Nian-Qiang Liu, Hsinchu (TW)

(73) Assignee: Wha Yu Industrial Co., Ltd., Hsinchu (TW)

( * ) Notice: Subject to any disclaimer, the term of this patent is extended or adjusted under 35 U.S.C. 154(b) by 376 days.

(21) Appl. No.: 13/017,516

(22) Filed: Jan. 31, 2011

(65) Prior Publication Data

US 2012/0194295 A1 Aug. 2, 2012

(51) Int. Cl.
*H01P 1/18* (2006.01)

(52) U.S. Cl.
USPC ..... 333/156

(58) Field of Classification Search
USPC ..... 333/24 R, 99 R, 136, 202, 219, 138, 333/156, 236, 245
See application file for complete search history.

(56) References Cited

U.S. PATENT DOCUMENTS 6,831,602 B2 * 12/2004 McKinzie et al. ..... 342/375

* cited by examiner

*Primary Examiner* — Benny Lee
*Assistant Examiner* — Rakesh Patel
(74) *Attorney, Agent, or Firm* — Egbert Law Offices, PLLC

(57) ABSTRACT

A phase shifter has a chamber with a holding space, a first feeder unit and a second feeder unit at the sides of the holding space, and at least one reversely configured electric regulation unit. The regulation unit contains a first coupling set with a movable and a fixed coupling, and a second coupling set with a movable and a fixed coupling. A sync linkage mechanism is used to link the respective movable couplings. A push-pull unit is linked to a driven connection of the sync linkage mechanism. A cover plate seals the holding space. The phase shifter configuration makes it possible to reduce markedly the volume and space of the phase shifter, cut down the manufacturing cost and improve the mating accuracy with higher applicability.

4 Claims, 6 Drawing Sheets

PHASE SHIFTER WITH REVERSELY CONFIGURED ELECTRIC REGULATION UNITS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a phase shifter, and more particularly to an innovative one which is fitted with a plurality of electric regulation units configured reversely.

2. Description of Related Art Including Information Disclosed Under 37 CFR 1.97 and 37 CFR 1.98.

With sharply increasing end users of mobile communication systems, especially in metropolitan areas where the consumer distribution is dense and time-dependently changing, many base stations are in full-load state. For instance, in the industrial and commercial regions, the distribution of mobile phones and PDAs varies markedly with the changing commuter time or holidays, so the load of the base stations covering these regions fluctuate obviously, leading to lower availability, degraded communication quality and waste of resources.

For the aforementioned problems and demands, an electric regulation antenna is extensively applied to the communication base stations in lieu of a common antenna. Said electric regulation antenna allows for regulation of the radiation angle of the antenna depending on the coverage, traffic and disturbance, etc, of the mobile network, thereby optimizing the communication network and QoS and improving the availability of resources.

Of which, the core component of said electric regulation antenna is a phase shifter involved in the present invention. However, the structure of the common phase shifter has some problems and shortcomings, such as for the phase shifter with a regulator that is formed by sleeving the coaxial tube with the transmission line (e.g.: U.S. Pat. No. 2,502,359), the bigger size leads to increasing cross section of the phase shifter, thus resulting in bigger space, inconvenient assembly and higher manufacturing cost, etc.

Moreover, another shortcoming of the common phase shifter lies in the configuration of the electric regulation units, where the shift of a plurality of electric regulation units is generally driven by a single push-pull unit, but the electric regulation efficiency is insufficient. Besides, the electric regulation efficiency is generally increased by connecting the multiple phase shifters in series, leading to substantial volume increase of the phase shifter and making it more difficult to improve the mating and functioning accuracy of components.

Thus, to overcome the aforementioned problems of the prior art, it would be an advancement if the art to provide an improved structure that can significantly improve the efficacy.

Therefore, the inventor has provided the present invention of practicability after deliberate experimentation and evaluation based on years of experience in the production, development and design of related products.

BRIEF SUMMARY OF THE INVENTION

The enhanced efficacy of the present invention is as follows.

Based on the unique configuration of the present invention wherein "the phase shifter with reversely configured electric regulation units" is mainly characterized by the arrangement of the reversely configured electric regulation units, the first movable coupling and first fixed coupling are operated reversely in relation to the second movable coupling and second fixed coupling. When the first movable coupling is elongated in relation to the first fixed coupling, the second movable coupling is shortened in relation to the second fixed coupling. With this configuration, the phase shifter may generate synchronously two kinds of shift (elongated and shortened) in the same phase shift process. The electric regulation efficiency of conventional multiple phase shifters can thus be realized by a single phase shifter of the present invention. If the same electric regulation efficiency is desired, the phase shifter of the present invention enables significant reduction of the volume and space of the electric regulation units while minimizing the manufacturing cost. Under the same volume and space, the phase shifter of the present invention can improve remarkably the scope and efficiency of electric regulation. Furthermore, based on the arrangement of reversely configured electric regulation units, the electric regulation units of the single phase shifter of the present invention are configured more intensively and densely, so the mating and operating precision of the components can be improved with higher stability and quality.

The improvements brought about by this invention are as follows.

Based on the configuration wherein a plurality of reversely configured electric regulation units are arranged, and the adjacent ones are arranged in parallel, the shorter phase shifter can realize bigger scope and ideal efficiency of electric regulation.

DETAILED DESCRIPTION OF THE INVENTION

Figure 1:
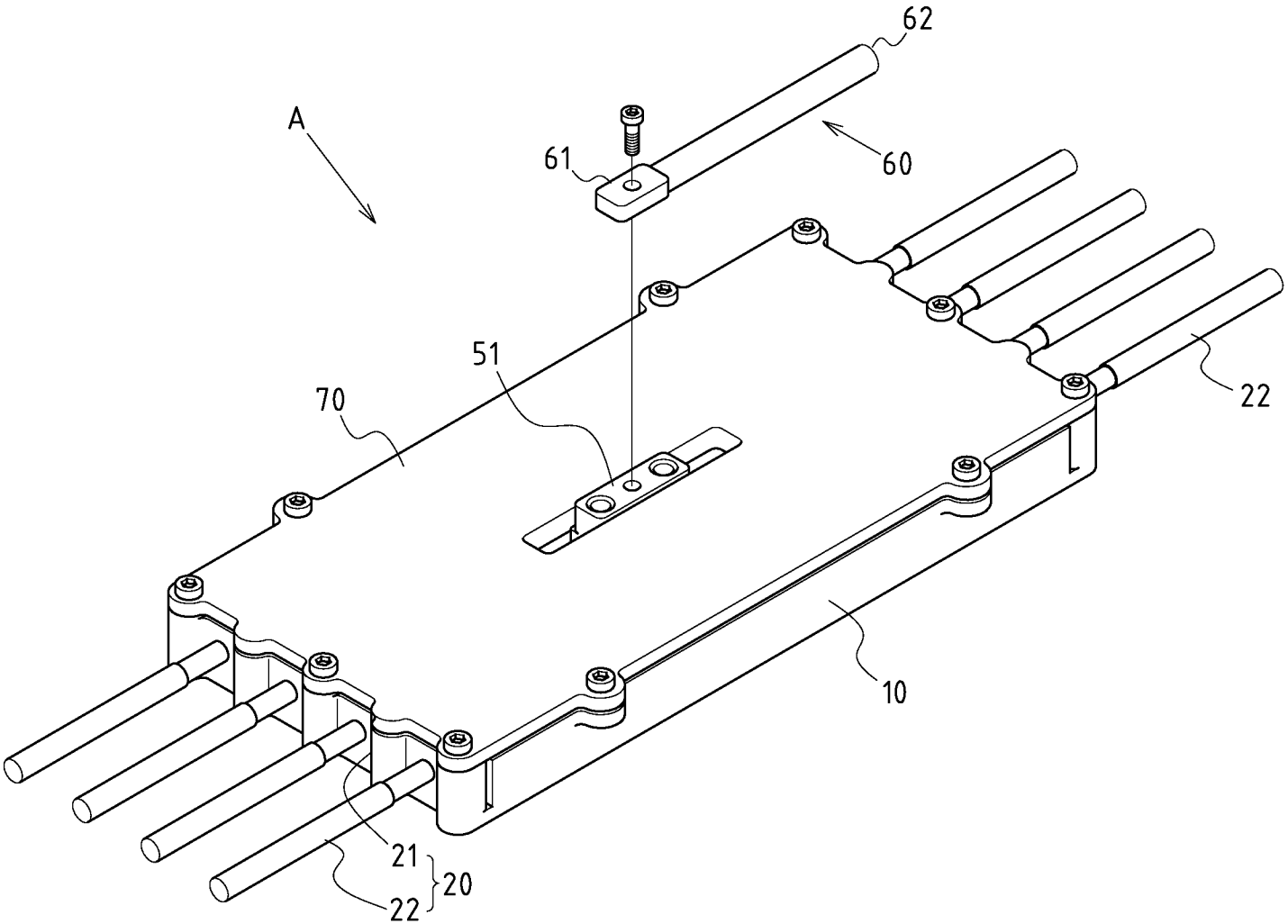
FIG. 1 is an assembled perspective view of the preferred embodiment of the phase shifter of the present invention.
Figure 2:
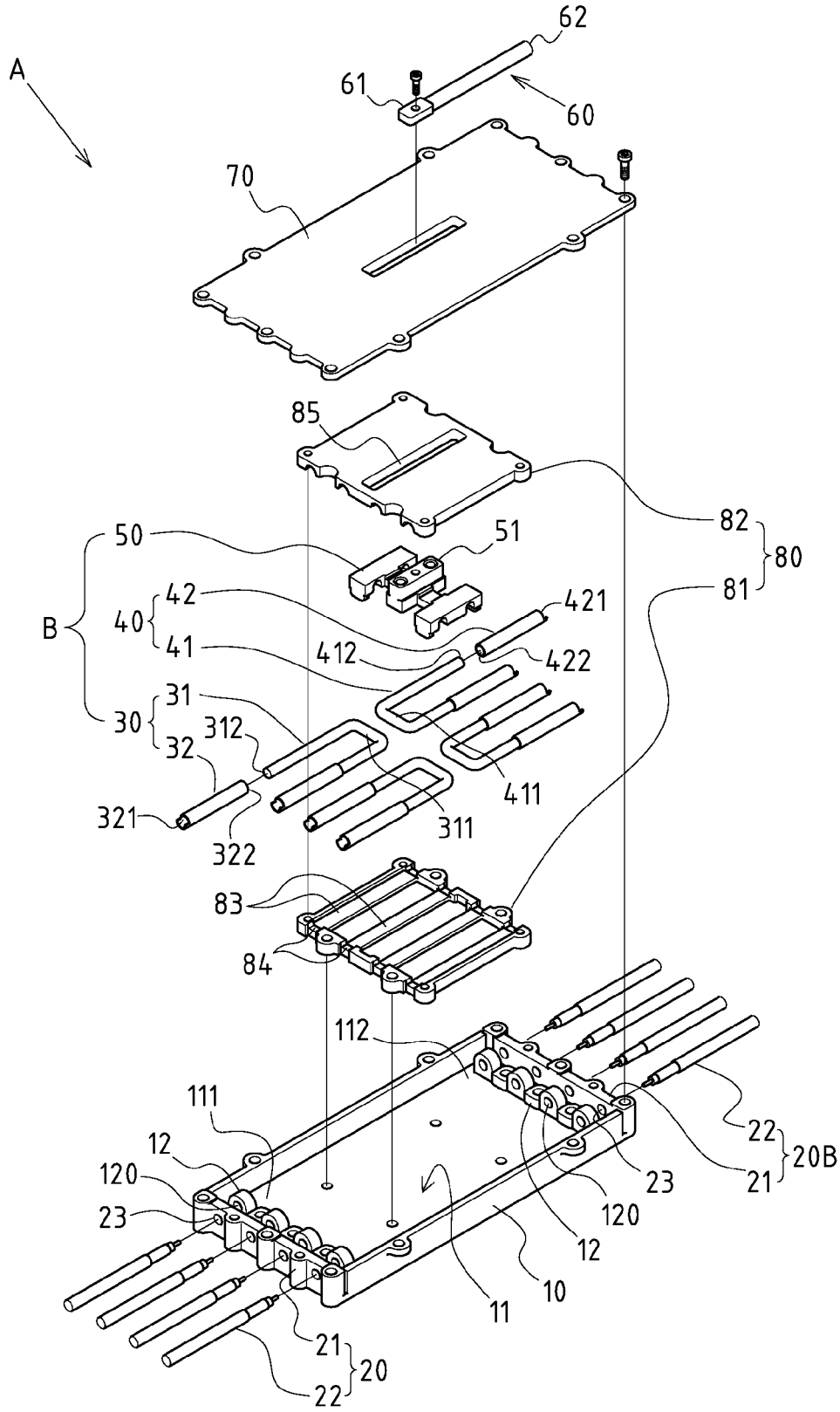
FIG. 2 is an exploded perspective view of the preferred embodiment of the phase shifter of the present invention.
Figure 3:
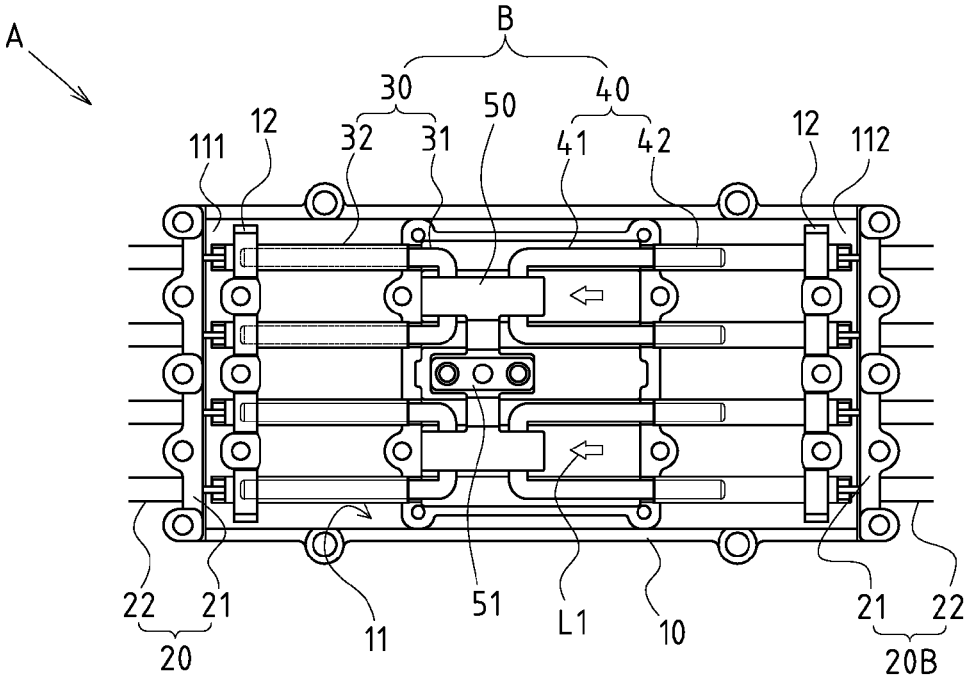
FIG. 3 is a schematic view of an operating status of the electric regulation unit of the present invention.

FIGS. 1-3 depict preferred embodiments of a phase shifter of the present invention with reversely configured electric regulation units, which, however, are provided for only explanatory objective for patent claims. Said phase shifter A includes a chamber 10, which is a flat body with opening that is formed by die casting and surface coating. A holding space 11 is shaped recessedly at one side of the chamber 10. The holding space 11 has a first side 111 and a second side 112.

A first feeder unit 20 and a second feeder unit 20B are provided, wherein the first feeder unit 20 is set at the first side 111 of the holding space 11, and the second feeder unit 20B is set at the second side 112 of the holding space 11. In this preferred embodiment, both the first feeder unit 20 and second feeder unit 20B have a feeder base 21 and cables 22, of which said feeder base 21 is located close to the first side 111 and second side 112 of the holding space 11, and the feeder base 21 is provided with a cable threading portion 23 (apertured or depressed pattern) for penetration of cables 22.

At least a reversely configured electric regulation unit B is set into the holding space 11 of the chamber 10. The reversely configured electric regulation unit B includes a first coupling set 30, placed close to the first side 111 of the holding space 11, and composed of a first movable coupling 31 and a first fixed coupling 32. The first movable coupling 31 is provided with a driven portion 311 and a coupling end 312. The first fixed coupling 32 is provided with a feeding connection 321 and a coupling portion 322. The feeding connection 321 is electrically connected with the first feeder unit 20, and the coupling portion 322 is coupled with the coupling end 312 of the first movable coupling 31. A second coupling set 40 is reversely configured with the first coupling set 30. The second coupling set 40 is composed of a second movable coupling 41 and a second fixed coupling 42. The second movable coupling 41 is provided with a driven portion 411 and a coupling end 412, and the second fixed coupling 42 is provided with a feeding connection 421 and a coupling portion 422. The feeding connection 421 is electrically connected with the second feeder unit 20B, and the coupling portion 422 is coupled with the coupling end 412 of the second movable coupling 41. A sync linkage mechanism 50, which is a plastic molding unit used to link the first and second movable couplings 31, 41, such that the first and second movable couplings 31, 41 can be synchronously driven by the sync linkage mechanism 50, so as to change the electric length of the entire phase shifter for the desired phase variation. Moreover, the sync linkage mechanism 50 is provided with a driven connection 51.

A push-pull unit 60 is provided, which is a long rod having a driving end 61 and a driven end 62. The driving end 61 is linked to the driven connection 51 for the sync linkage mechanism 50 of the reversely configured electric regulation units B. The driven end 62 is extended to an outside preset location of the phase shifter A, permitting the driving via a drive device (e.g.: motor).

A cover plate 70 is used to seal the holding space 11 of the chamber 10, and also to conceal limitedly the push-pull unit 60 of the reversely configured electric regulation units B.

Of which, the first and second coupling sets 30, 40 of the reversely configured electric regulation units B are mated into a tubular column pattern. Of which, the first and second movable couplings 31, 41 are formed into a U-shaped cylinder, while the first and second fixed couplings 32, 42 are formed into a copper tube. A seat 12 is separately set within the holding space 11 close to the first side 111 and second side 112. The seat 12 is provided with a through-hole 120 for penetration and positioning of the first and second fixed couplings 32, 42. A guiding assembly 80 is assembled into the holding space 11 of the chamber 10. The guiding assembly 80 has a permanent seat 81 and a seat cover 82, both of which are PE plates. The permanent seat 81 is provided with long guide slots 83 arranged at interval. Both ends of the guide slot 83 are provided with a trough 84 for limiting the U-shaped cylindrical first and second movable couplings 31, 41. The first and second movable couplings 31, 41 can be evenly placed onto the permanent seat 81. The seat cover 82 is covered onto the permanent seat 81. Besides, the seat cover 82 is provided with a through-hole 85 for penetration of the driven connection 51 of the sync linkage mechanism 50.

Figure 4:
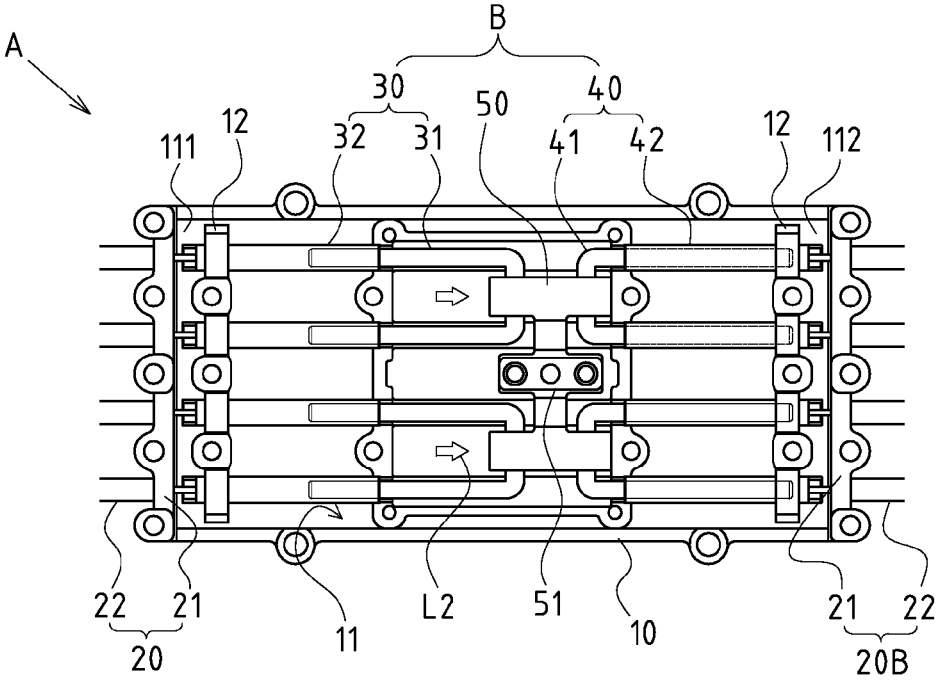
FIG. 4 is a schematic view of another operating status of the electric regulation unit of the present invention.

Based on above-specified structural configuration, the present invention is operated as follows:

Referring to FIGS. 3 and 4, said phase shifter A is operated in such a manner that the push-pull unit 60 shifts extensibly and then the sync linkage mechanism 50 drives the first and second movable couplings 31, 41 (marked by arrow L1, L2). With a U-shaped pattern design, the first and second movable couplings 31, 41 shift towards the first and second fixed couplings 32, 42, so as to change the electric length of the entire phase shifter for the desired phase variation.

It is worthy to note that an insulating medium is set at the coupling position between the first/second movable couplings 31, 41 and the first/second fixed couplings 32, 42, so both of them are coupled inductively, instead of being coupled electrically by the contact of conductive materials.

The present invention is characterized by the arrangement of the reversely configured electric regulation units B, so the first movable coupling 31 and first fixed coupling 32 are operated reversely in relation to the second movable coupling 41 and second fixed coupling 42. When the first movable coupling 31 is elongated in relation to the first fixed coupling 32 (i.e.: electric length is elongated), the second movable coupling 41 is shortened in relation to the second fixed coupling 42 (i.e.: electric length is shortened). With this configuration, the phase shifter may generate synchronously two kinds of shift (elongated and shortened) in the same phase shift process; the electric regulation efficiency of conventional multiple phase shifters can be realized by a single phase shifter of the present invention. If the same electric regulation efficiency is desired, the phase shifter A of the present invention enables to reduce significantly the volume and space of the electric regulation units while minimizing the manufacturing cost. Under the same volume and space, the phase shifter A of the present invention can improve remarkably the scope and efficiency of electric regulation. Furthermore, based on the arrangement of reversely configured electric regulation units B, the electric regulation units of the single phase shifter of the present invention are arranged more intensively and densely, so the mating and operating precision of the components can be improved with higher stability and quality.

Referring to FIG. 2, when a plurality of reversely configured electric regulation units B are arranged, the adjacent reversely configured electric regulation units B are arranged in parallel. Moreover, the driving end 61 of the push-pull unit 60 is linked to the sync linkage mechanism 50 of the reversely configured electric regulation units B, so as to drive synchronously a plurality of reversely configured electric regulation units B. With the design of parallel configuration, the shorter phase shifter A can realize bigger scope and ideal efficiency of electric regulation.

Figure 5:
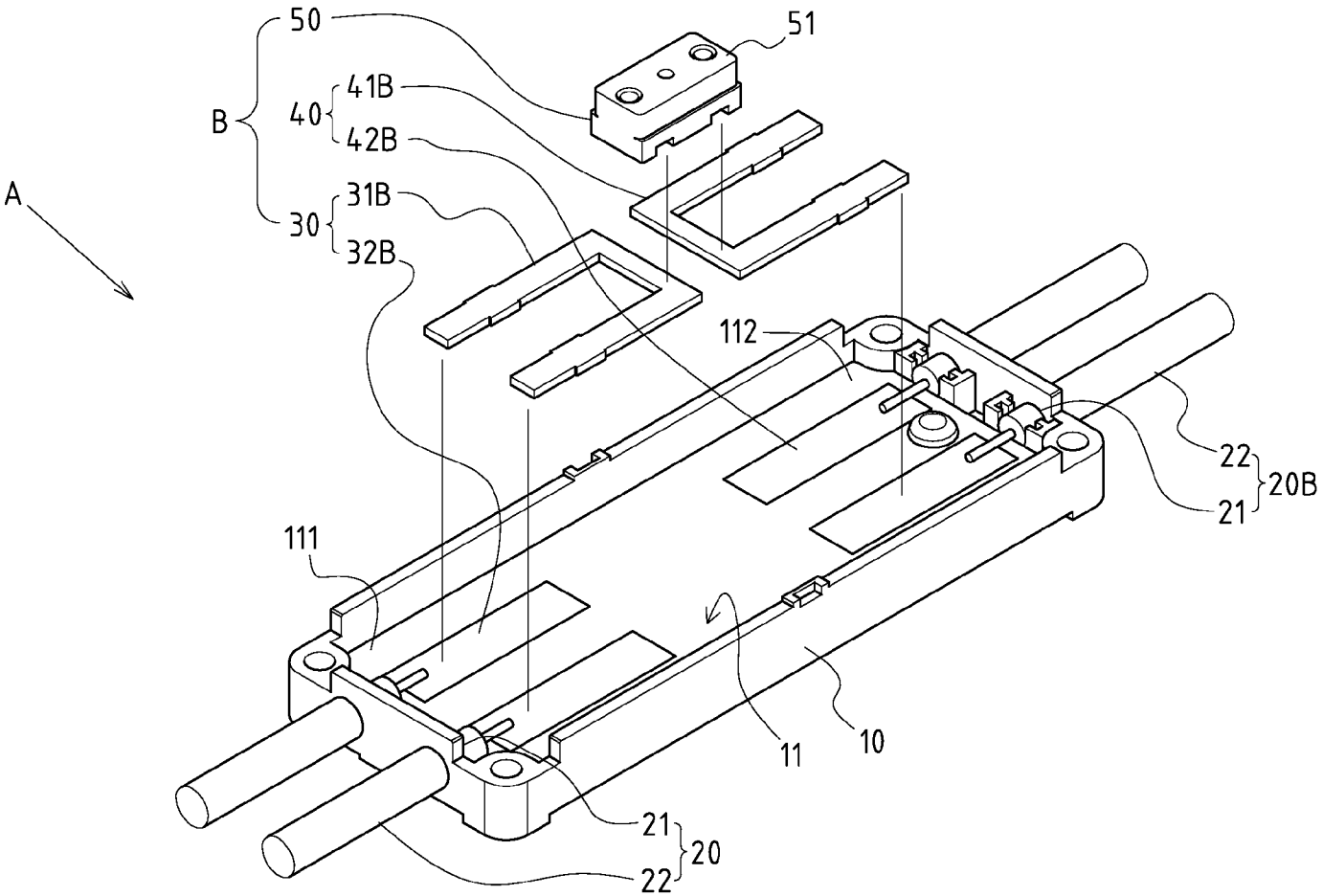
FIG. 5 is a schematic view of the present invention wherein the coupling parts are configured into a plate pattern.

Referring also to FIG. 5, the first and second coupling sets 30, 40 of the reversely configured electric regulation unit B can be mated into a plate pattern, so the first and second movable couplings 31B, 41B are formed into U-shaped plate, and the first and second fixed coupling 32B, 42B are formed into straight plate, with the same technical characteristic and operating principle as the aforementioned preferred embodiment.

Figure 6:
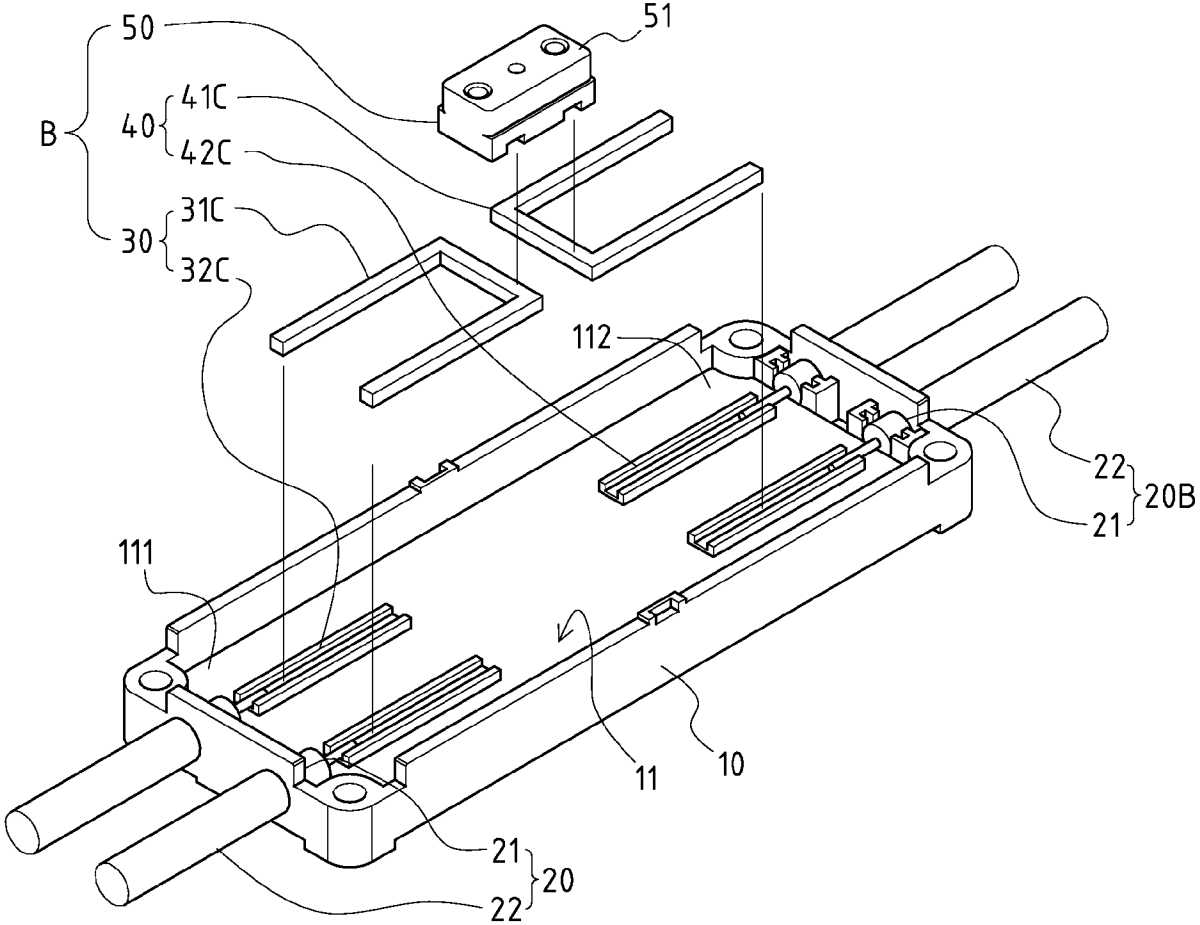
FIG. 6 is a schematic view of the present invention wherein the coupling parts are configured into a combined pattern of strip and groove.

Referring also to FIG. 6, the first and second coupling sets 30, 40 of the reversely configured electric regulation unit B can be mated into a combined pattern of strip and groove, so that the first and second movable couplings 31C, 41C are formed into U-shaped strip pattern, and the first and second fixed couplings 32C, 42C are formed into grooved seat, with the same technical characteristic and operating principle as the aforementioned preferred embodiment.

Figure 7:
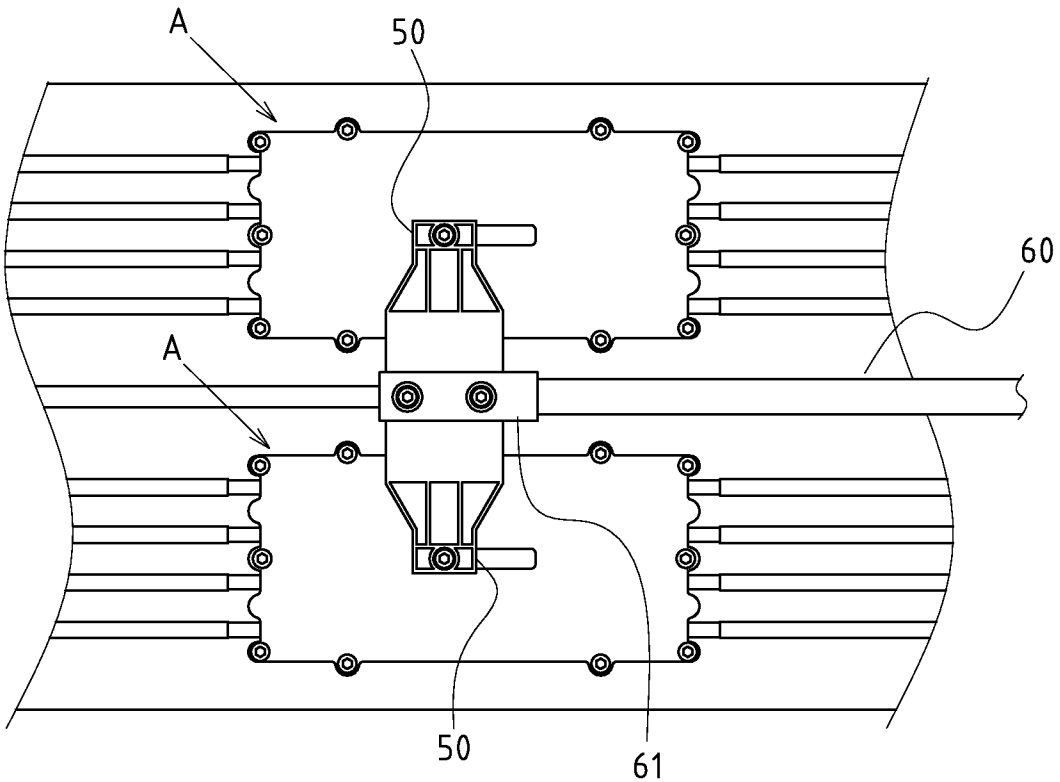
FIG. 7 is an isolated view of the present invention wherein a plurality of phase shifters are arranged in parallel and synchronized.

Referring also to FIG. 7, a plurality of said phase shifters A can be arranged in parallel, whilst the driving end 61 of a push-pull unit 60 is linked to the sync linkage mechanism 50 of the phase shifters A for synchronous driving.

We claim:

1. A phase shifter apparatus comprising:

a chamber having a recessed holding space at one side thereof, said holding space having a first and a second side;

a first feeder unit and a second feeder unit, said first feeder unit positioned at the first side of said holding space, said second feeder unit positioned at the second side of said holding space;

at least one reversely configured electric regulation unit positioned into said holding space of said chamber, the at least one reversely configured electric regulation unit comprising:

a first coupling set placed close to the first side of said holding space, said first coupling set having a first movable coupling and a first fixed coupling, said first movable coupling is provided with a first driven portion and a first coupling end, said first fixed coupling is provided with a first feeding connection and a first coupling portion, said first feeding connection is electrically connected with said first feeder unit, said first coupling portion is coupled with said first coupling end of said first movable coupling;

a second coupling set reversely configured with said first coupling set, said second coupling set having a second movable coupling and a second fixed coupling, said second movable coupling is provided with a second driven portion and a second coupling end, said second fixed coupling is provided with a second feeding connection and a second coupling portion, said second feeding connection is electrically connected with said second feeder unit, said second coupling portion is coupled with the second coupling end of said second movable coupling;

a sync linkage mechanism linking the first and second movable couplings such that the first and second movable couplings can be synchronously driven by said sync linkage mechanism, said sync linkage mechanism is provided with a driven connection;

a push-pull unit having a driving end and a driven end, the driving end is linked to the driven connection of said sync linkage mechanism, said driven end is extended to a preset location of the phase shifter; and a cover plate sealing said holding space of said chamber and partially concealing said push-pull unit, wherein the first and second coupling sets are mated into a tubular column pattern, the first and second movable couplings are formed into a U-shaped cylinder, the first and second fixed couplings are formed into a copper tube, a seat is separately set within the holding space close to the first and second sides, said seat has a through-hole for penetration and positioning of the first and second fixed couplings, a guiding assembly is assembled into the holding space of said chamber, said guiding assembly has a permanent seat and a seat cover, said permanent seat has elongated guide slots arranged in spaced relation, both ends of the elongated guide slots are provided with a trough for fixing the first and second movable couplings, the seat cover covers the permanent seat, said seat cover is provided with a through-hole for penetration of the driven connection of the sync linkage mechanism, the driven connection is connectable to the driving end of the push-pull unit, said at least one reversely configured electric regulation unit is set into the holding space of said chamber, both of the first and second feeder units have a feeder base and cables, said feeder base is located close to the first and second sides of said holding space, said feeder base has a cable threading portion.

2. A phase shifter apparatus comprising:

a chamber having a recessed holding space at one side thereof, said holding space having a first and a second side;

a first feeder unit and a second feeder unit, said first feeder unit positioned at the first side of said holding space, said second feeder unit positioned at the second side of said holding space;

at least one reversely configured electric regulation unit positioned into said holding space of said chamber, the at least one reversely configured electric regulation unit comprising:

a first coupling set placed close to the first side of said holding space, said first coupling set having a first movable coupling and a first fixed coupling, said first movable coupling is provided with a first driven portion and a first coupling end, said first fixed coupling is provided with a first feeding connection and a first coupling portion, said first feeding connection is electrically connected with said first feeder unit, said first coupling portion is coupled with said first coupling end of said first movable coupling;

a second coupling set reversely configured with said first coupling set, said second coupling set having a second movable coupling and a second fixed coupling, said second movable coupling is provided with a second driven portion and a second coupling end, said second fixed coupling is provided with a second feeding connection and a second coupling portion, said second feeding connection is electrically connected with said second feeder unit, said second coupling portion is coupled with the second coupling end of said second movable coupling;

a sync linkage mechanism linking the first and second movable couplings such that the first and second movable couplings can be synchronously driven by said sync linkage mechanism, said sync linkage mechanism is provided with a driven connection;

a push-pull unit having a driving end and a driven end, the driving end is linked to the driven connection of said sync linkage mechanism, said driven end is extended to a preset location of the phase shifter; and a cover plate sealing said holding space of said chamber and partially concealing said push-pull unit, the driven connection for said sync linkage mechanism links the driving end of said push-pull unit, the first and second coupling sets of said at least one reversely configured electric regulation unit is matable into a strip and groove pattern so that the first and second movable couplings are formed into a U-shaped strip pattern, the first and second fixed couplings are formed into a grooved seat, said at least one reversely configured electric regulation unit is set into the holding space of said chamber; both of the first and second feeder units have a feeder base and cables, said feeder base is located close to the first and second sides of said holding space, the feeder base is provided with a cable threading portion.

3. A phase shifter apparatus comprising:

a chamber having a recessed holding space at one side thereof, said holding space having a first and a second side;

a first feeder unit and a second feeder unit, said first feeder unit positioned at the first side of said holding space, said second feeder unit positioned at the second side of said holding space;

at least one reversely configured electric regulation unit positioned into said holding space of said chamber, the at least one reversely configured electric regulation unit comprising:

a first coupling set placed close to the first side of said holding space, said first coupling set having a first movable coupling and a first fixed coupling, said first movable coupling is provided with a first driven portion and a first coupling end, said first fixed coupling is provided with a first feeding connection and a first coupling portion, said first feeding connection is electrically connected with said first feeder unit, said first coupling portion is coupled with said first coupling end of said first movable coupling;

a second coupling set reversely configured with said first coupling set, said second coupling set having a second movable coupling and a second fixed coupling, said second movable coupling is provided with a second driven portion and a second coupling end, said second fixed coupling is provided with a second feeding connection and a second coupling portion, said second feeding connection is electrically connected with said second feeder unit, said second coupling portion is coupled with the second coupling end of said second movable coupling;

a sync linkage mechanism linking the first and second movable couplings such that the first and second movable couplings can be synchronously driven by said sync linkage mechanism, said sync linkage mechanism is provided with a driven connection;

a push-pull unit having a driving end and a driven end, the driving end is linked to the driven connection of said sync linkage mechanism, said driven end is extended to a preset location of the phase shifter; and a cover plate sealing said holding space of said chamber and partially concealing said push-pull unit, the first and second coupling sets of the at least one reversely configured electric regulation unit is matable into a combined pattern of strip and groove such that the first and second movable couplings are formed into a U-shaped strip pattern, the first and second fixed couplings are formed into a grooved seat.

4. The phase shifter apparatus of claim 2, wherein said push-pull unit is an elongated rod.

* * * * *